US010681970B2

(12) United States Patent
McManus

(10) Patent No.: US 10,681,970 B2
(45) Date of Patent: Jun. 16, 2020

(54) TRANSLUCENT RECONFIGURABLE BAG

(71) Applicant: Ervin McManus, Fort Worth, TX (US)

(72) Inventor: Ervin McManus, Fort Worth, TX (US)

( * ) Notice: Subject to any disclaimer, the term of this patent is extended or adjusted under 35 U.S.C. 154(b) by 0 days.

(21) Appl. No.: 16/248,916

(22) Filed: Jan. 16, 2019

(65) Prior Publication Data

US 2019/0239612 A1 Aug. 8, 2019

Related U.S. Application Data

(60) Provisional application No. 62/625,598, filed on Feb. 2, 2018.

(51) Int. Cl.

| | |
|---|---|
| ***A45F 3/04*** | (2006.01) |
| ***A45C 15/06*** | (2006.01) |
| ***A45C 13/10*** | (2006.01) |
| ***A45C 13/30*** | (2006.01) |
| ***A45C 7/00*** | (2006.01) |
| ***A45C 1/02*** | (2006.01) |
| ***A45C 5/02*** | (2006.01) |
| ***A45C 3/00*** | (2006.01) |
| *A45F 3/00* | (2006.01) |

(52) U.S. Cl.

CPC ..... *A45C 15/06* (2013.01); *A45C 1/02* (2013.01); *A45C 3/001* (2013.01); *A45C 5/02* (2013.01); *A45C 7/00* (2013.01); *A45C 7/0036* (2013.01); *A45C 7/0077* (2013.01); *A45C 13/103* (2013.01); *A45C 13/30* (2013.01); *A45F 3/04* (2013.01); *A45C 2007/0004* (2013.01); *A45C 2200/10* (2013.01); *A45F 2003/003* (2013.01)

(58) Field of Classification Search

CPC ..... A45F 2003/003; A45F 5/02; A45F 3/04; A45C 15/06; A45C 13/002; A45C 11/00; B65D 69/00; B65D 25/54

See application file for complete search history.

(56) References Cited

U.S. PATENT DOCUMENTS

| | | | | | |
|---|---|---|---|---|---|
| 3,807,537 | A * | 4/1974 | O'Reilly | A45C 3/02 | 190/121 |
| 3,808,416 | A | 4/1974 | Pottratz | | |
| 3,865,234 | A * | 2/1975 | Kester | B65D 81/00 | 206/770 |
| 3,870,132 | A * | 3/1975 | Hanley | A45C 3/00 | 190/109 |
| 5,073,844 | A * | 12/1991 | Coyner | A45C 15/06 | 362/156 |

(Continued)

*Primary Examiner* — Brian D Nash

(74) *Attorney, Agent, or Firm* — Boudwin Intellectual Property; Daniel Boudwin

(57) ABSTRACT

A translucent reconfigurable bag designed to fold into a bag from a flattened member. The translucent reconfigurable bag includes a planar member having an inner side and an outer side, and composed of a plurality of panels, wherein each panel is translucent. The outer side and the inner side of the planar member each have at least one fastener with the two fasteners designed to secure to one another. The inner fastener and outer fastener are designed to allow the plurality of panels to fold and affix to one another, thereby forming an interior volume having an opening in communication with the interior volume. A light is disposed on one of the panels and is designed to activate when spoken to. In this way, a user is able to create a bag from an easily transportable planar member and quickly find items inside said bag.

20 Claims, 3 Drawing Sheets

(56) References Cited

U.S. PATENT DOCUMENTS 5,255,833 A * 10/1993 McAllister ..... A45F 3/02 150/110
5,351,813 A * 10/1994 Golovan ..... A45C 11/18 206/449
5,524,802 A * 6/1996 Benson ..... A45C 1/04 224/194
5,573,154 A * 11/1996 Tietze ..... A45F 3/04 190/110
5,836,671 A * 11/1998 Chien ..... A45C 15/06 362/84
5,896,962 A * 4/1999 Smith ..... A45C 3/00 190/107
6,193,118 B1 * 2/2001 Kearl ..... A45C 7/0095 108/43
6,237,660 B1 * 5/2001 Giardino ..... A45C 3/06 150/105
6,237,825 B1 * 5/2001 Pencoske ..... A45C 13/08 224/627
6,328,158 B1 * 12/2001 Bisbal ..... A45C 3/00 206/223
6,447,142 B1 * 9/2002 Weir ..... A45C 15/06 150/100
6,637,485 B1 * 10/2003 Sartena ..... A45C 3/06 150/101
6,668,990 B2 * 12/2003 Humiston, Jr. ..... A45C 7/0095 190/107
6,726,019 B2 * 4/2004 Leung ..... B65D 25/04 206/769
6,923,302 B2 * 8/2005 Godshaw ..... A45C 3/00 190/109
7,111,959 B2 * 9/2006 Kurcz ..... A45C 15/06 362/155
7,553,043 B2 * 6/2009 Venn ..... F21L 4/00 362/103
7,598,861 B2 * 10/2009 Belden, Jr. ..... E05B 73/0023 116/86
7,892,064 B2 * 2/2011 Carruth ..... A63H 33/00 190/109
8,282,235 B2 10/2012 Gilligan
8,494,507 B1 * 7/2013 Tedesco ..... A61F 4/00 434/112
9,568,183 B2 * 2/2017 Voskanian ..... A45C 15/06
9,603,123 B1 * 3/2017 Jackson ..... H04M 1/72569
9,605,839 B2 3/2017 Tait
9,877,558 B1 * 1/2018 Harstvedt ..... A45C 3/00
10,171,058 B1 * 1/2019 Alameh ..... H03G 3/3005
2002/0109596 A1 * 8/2002 Phillips ..... G08B 1/08 340/573.1
2007/0228091 A1 * 10/2007 Shawen ..... A45C 15/00 224/153
2007/0279918 A1 12/2007 Francis
2012/0212940 A1 8/2012 Leuty
2014/0061273 A1 * 3/2014 Bullivant ..... A45F 3/04 224/576
2014/0222436 A1 * 8/2014 Binder ..... G10L 15/265 704/275
2014/0267799 A1 * 9/2014 Sadasivam ..... H04N 5/23216 348/207.99
2015/0327647 A1 11/2015 Wiklacz
2017/0052613 A1 * 2/2017 Alameh ..... G06F 3/165

* cited by examiner

TRANSLUCENT RECONFIGURABLE BAG

CROSS REFERENCE TO RELATED APPLICATIONS

This application claims the benefit of U.S. Provisional Application No. 62/625,598 filed on Feb. 2, 2018. The above identified patent application is herein incorporated by reference in its entirety to provide continuity of disclosure.

BACKGROUND OF THE INVENTION

The present invention relates to translucent bags. More specifically, the invention provides a translucent planar member having a light and composed of a plurality of panels, wherein the panels are configured to affix to one another thereby forming an interior volume.

Many people transport their everyday items in a purse or bag. However, when the bag is full of objects it is difficult for an individual to find the specific item they're searching for. Although it possible to pull out a flashlight to provide additional light when searching for the specific item, this is an additional hassle and frustration for the user. Further, additional bags can take up space when traveling, making it difficult to bring extra bags along on a trip. Thus, an improved translucent bag that can reconfigure from a flat surface to a bag and provide a means of easily seeing the items stored within is desired.

SUMMARY OF THE INVENTION

In view of the foregoing disadvantages inherent in the known types of translucent reconfigurable bags now present in the known art, the present invention provides a translucent reconfigurable bag wherein the same can be utilized for providing convenience for the user when desiring to quickly and easily find items inside of a bag.

The present system comprises a translucent reconfigurable bag. The translucent reconfigurable bag comprises a planar member, having an inner side and an outer side, and composed of a plurality of panels, wherein each panel of the plurality of panels are translucent. The outer side and the inner side of the planar member each have at least one fastener disposed thereon and configured to removably secure to one another. The inner fastener and outer fastener are configured to allow the plurality of panels to foldably reconfigure and affix to one another, thereby forming an interior volume with an opening in communication with the interior volume. A light configured to actuate automatically when the fasteners are separated is disposed on the planar member. In this way, a user is able to reconfigure a specific bag from an easily transportable planar member and quickly find items inside said bag.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1B:
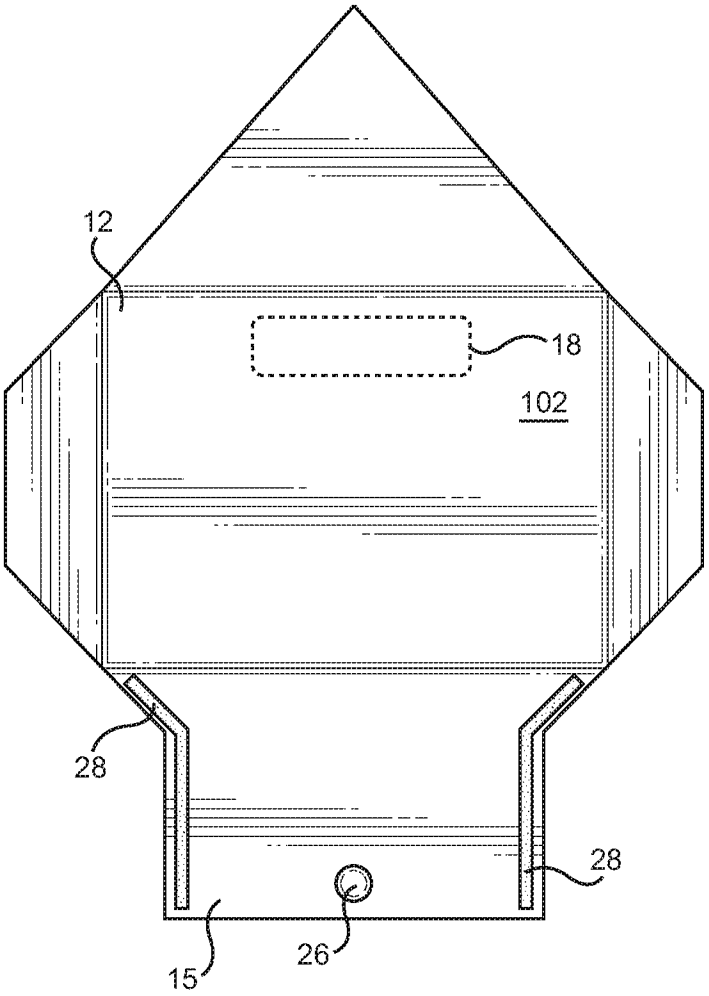
FIG. 1B shows a bottom plan view of an embodiment of the translucent reconfigurable bag in an unfolded configuration.

Reference is made herein to the attached drawings. Like reference numerals are used throughout the drawings to depict like or similar elements of the translucent reconfigurable bag. The figures are intended for representative purposes only and should not be considered to be limiting in any respect.

Figure 1A:
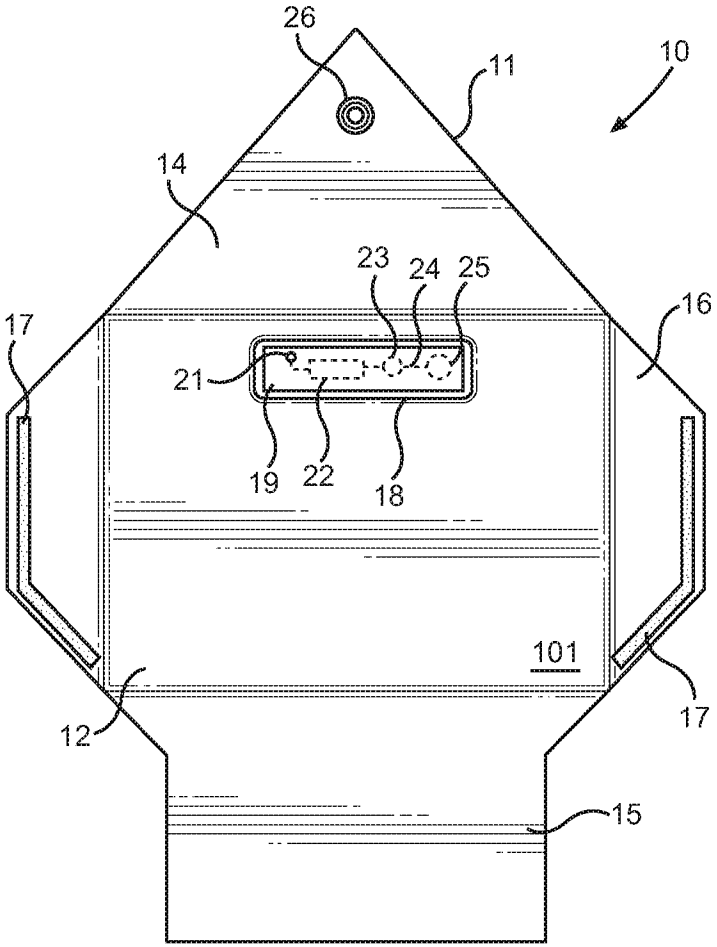
FIG. 1A shows a top plan view of an embodiment of the translucent reconfigurable bag in an unfolded configuration.

Referring now to FIG. 1A, there is shown a top plan view of an embodiment of the translucent reconfigurable bag in an unfolded configuration. A translucent reconfigurable bag 10 comprises a planar member 11 having an inner side 101. The planar member 11 is composed of a plurality of panels, wherein each panel is foldable along a seam. The translucent reconfigurable bag 10 comprises an unfolded configuration when the planar member 11 is flattened such that the plurality of panels are all unfolded.

In the illustrated embodiment, the plurality of panels includes a central panel 12. A top panel 14, a bottom panel 15 disposed opposite the top panel 14, and a pair of side panels 16, each disposed opposite one another and perpendicular to the top panel 14 and bottom panel 15, extend outward from the central panel 12. In the shown embodiment, the pair of side panels 16 are equivalent in size to one another. In the illustrated embodiment, each panel of the plurality of panels is translucent. In the illustrated embodiment, the top panel 14, the bottom panel 15, and the pair of side panels 16 each have equivalent values of translucency, such that one panel is not more or less translucent than any other thereby enabling the user to view items through any panel and allowing them to view the contents of the translucent reconfigurable bag 10 at any angle. In other embodiments, however, at least one of the panels is less translucent than the others to provide a measure of privacy to the user.

In the illustrated embodiment, the plurality of panels are configured to fold into an envelope or clutch purse that allows the user to store a plurality of items therein. As such, the bottom panel 15 comprises a rectangular portion having a tapered edge where the bottom panel 15 affixes to the central panel 12. In this way, the bottom panel 15 is configured to form a supported bottom when the translucent reconfigurable bag 10 is in a folded configuration.

A light 18 is disposed on the inner side 101 of the planar member 11. In the illustrated embodiment, a cover 19 is disposed over the light 18 to protect the circuitry therein. Thus, the cover 19 is composed of a translucent but durable material, such as plastic, thereby preventing lux produced by the light 18 from decreasing while continuing to provide a protection against items accidentally hitting and damaging the light 18. In the illustrated embodiment, the light 18 further comprises an LED 25 operably connected to a power source 23, such as a coin cell battery. In the shown embodiment, the cover 19 is removably secured overtop the light 18, such that the power source 23 can be exchanged for an alternate power source when depleted of power.

The light 18 is configured to actuate automatically, thereby allowing the user to quickly and easily activate the light 18. In one embodiment, the light 18 is actuated through a change in the ambient light, such that the light 18 is actuated when a user opens the translucent reconfigurable bag 10. In another embodiment, the light 18 can be activated via an auditory cue, such as a word or phrase spoken by an individual. Thus, in the illustrated embodiment, the light 18 further comprises a microphone 21, wherein the microphone 21 is visible from the cover 19 and is operably connected to the LED 25. The microphone 21 is regulated through a control circuit 22, wherein the control circuit 22 is configured to recognize the predetermined audio input and actuate the LED 25 accordingly. In the shown embodiment, the LED 25, the power source 23, the control circuit 22, and the microphone 21 are all operably connected via at least one wire 24. The wire 24 is configured to allow the circuitry within the light 18 to communicate with one another.

The planar member 11 is configured to foldably reconfigure the panels to form a storage container. In the shown embodiment, a pair of inner fasteners 17 are disposed along a perimeter of the pair of side panels 16, such that the pair of inner fasteners 17 are rectangular and configured to follow the angle of the respective side panel 16 each is disposed on. The pair of inner fasteners 17 are configured to removably secure to a mating pair of outer fasteners disposed on an outer side of the planar member 11, thereby forming the translucent reconfigurable bag 10. In the illustrated embodiment, the inner fasteners 17 are composed of a thin magnetic strip to allow for a secure hold that allows easy reconfigurability. However, in other embodiments other suitably secure fasteners such as a hook and loop are used. Additionally, a bag fastener 26 is disposed on the top panel 14. The bag fastener 25 is configured to securely close the translucent reconfigurable bag 10 when the translucent reconfigurable bag 10 is folded.

Referring now to FIG. 1B, there is shown a bottom plan view of an embodiment of the translucent reconfigurable bag in an unfolded configuration. The planar member further comprises an outer side 102. In one embodiment, the planar member is completely transparent such that the light 18 can be viewed from the outer side 102 of the planar member, thereby allowing the user to easily find the translucent reconfigurable bag if lost in the dark.

In the shown embodiment, a pair of outer fasteners 28 are disposed along a perimeter of the bottom panel 15. The pair of outer fasteners 28 are configured to align with the inner fasteners disposed along the inner side of the side panels, such that when the bottom panel 15 is folded towards the inner side, the side panels fold inward and removably secure thereto the bottom panel 15. Further, when the bottom panel 15 is folded inwards, the bag fastener 26 is positioned to removably secure to the mated fastener disposed on the inner side of the top panel.

Figure 2:
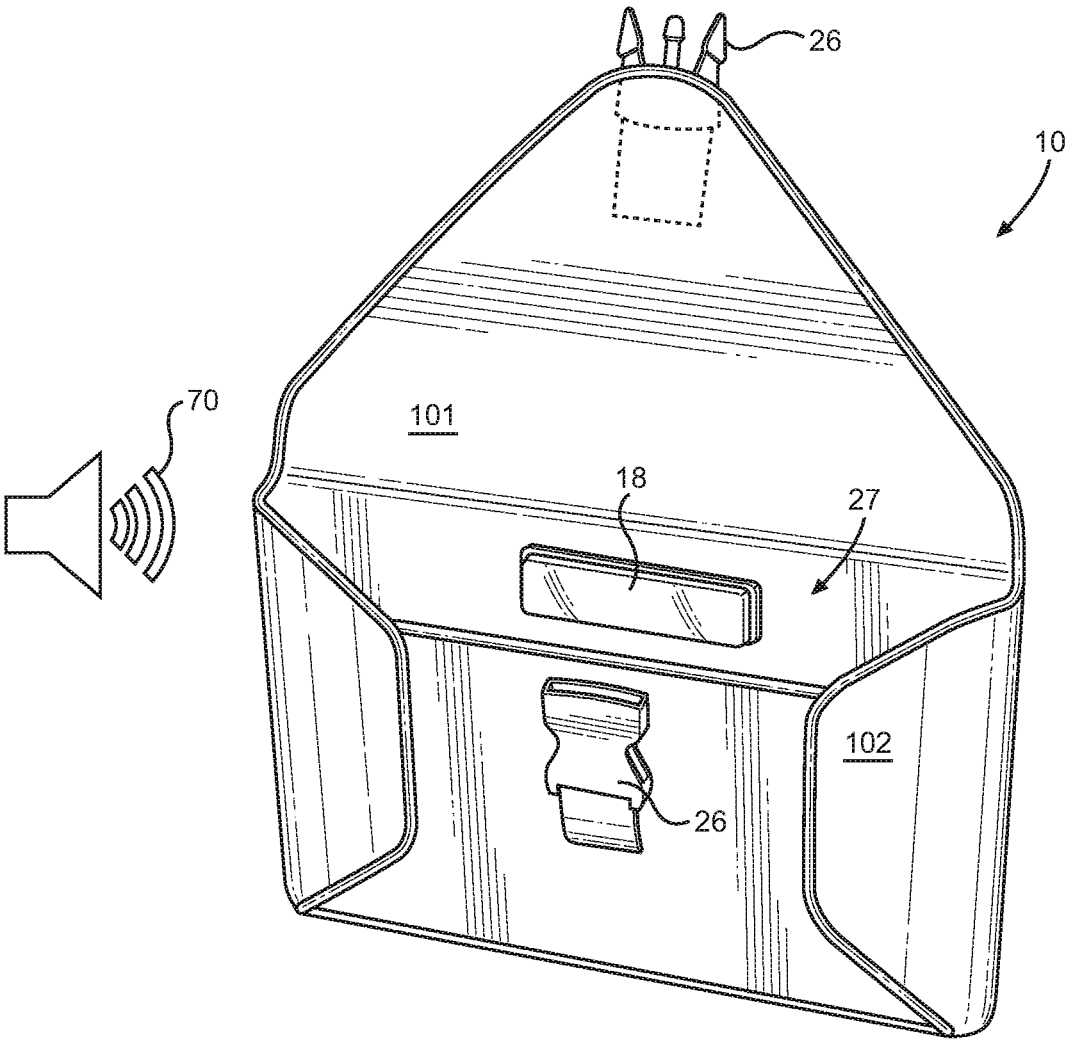
FIG. 2 shows a perspective view of an embodiment of the translucent reconfigurable bag in a folded configuration.

Referring now to FIG. 2, there is shown a perspective view of an embodiment of the translucent reconfigurable bag in a folded configuration. As previously described, the plurality of panels are foldable and configured to affix to one another via the inner fasteners disposed on the inner side 101 removably securing to the outer fasteners disposed on the outer side 102. In this way, the translucent reconfigurable bag 10 is reconfigurable from an unfolded configuration, wherein the translucent reconfigurable bag 10 is planar, into a folded configuration, wherein the translucent reconfigurable bag 10 has an interior volume 27 with an opening in communication with the interior volume 27. In this way, the translucent reconfigurable bag 10 can be easily transported or packed when in the unfolded configuration and can reconfigure into the folded configuration when additional storage is necessary.

In the illustrated embodiment, the folded configuration resembles an envelope or clutch purse, thereby allowing the user to carry the translucent reconfigurable bag 10 with one hand to ensure easy transport. However, in other embodiments, the folded configuration can resemble other shaped bags configured to hold additional items or specific items. As such, in other embodiments the translucent reconfigurable bag 10 has an unfolded configuration corresponding to the respective folded configuration. Once the translucent reconfigurable bag 10 is reconfigured to the folded configuration, the interior volume 27 translucent reconfigurable bag 10 is removably secured using the pair of bag fasteners 26. In the illustrated embodiment, the pair of bag fasteners 26 comprise a clip buckle with a male end disposed on the outer side 13 of the top panel and a mated receiving female end on the outer side 13 of the bottom panel. The pair of clip buckles 26 allow elderly users or users having poor hand strength to easily secure and unsecure the translucent reconfigurable bag 10. However, in other embodiments, any suitable fastener, such as a pair of magnets or a pair of snap clips, can be used for the pair of bag fasteners 26, depending on the preference of the user.

In the shown embodiment, the light 18 is disposed on the inner side 101 near the top panel such that the light 18 is enclosed in the interior volume 27 when the translucent reconfigurable bag 10 is sealed via the bag fasteners 26. Thus, when the translucent reconfigurable bag 10 is filled with a plurality of items, the light 18 is not concealed by the items and continues to provide illumination for the user. However, in other embodiments, the light 18 is disposed on the inner side 101 midway between the top panel and the bottom panel, or immediately proximal to the bottom panel, such that the light 18 can illuminate items within the translucent reconfigurable bag 10 from the side or from below, depending on the user's preferred orientation of the light 18. Further, different locations for the light 18 can provide preferred illumination depending on the number of items the user carries on average, such that a user who carries only a few items may desire the light 18 disposed at the bottom of the translucent reconfigurable bag 10 to provide illumination throughout.

In the illustrated embodiment, the light 18 is configured to respond to an auditory cue 70, such that a specific sound, such as a word or phrase, will actuate the light 18. In one embodiment, the same noise will both turn the light 18 on and turn the light 18 off. However, in another embodiment, a first noise, such as speaking the word "on," will turn the light 18 on, and a second noise, such as speaking the word "off," will turn the light 18 off.

Figure 3:
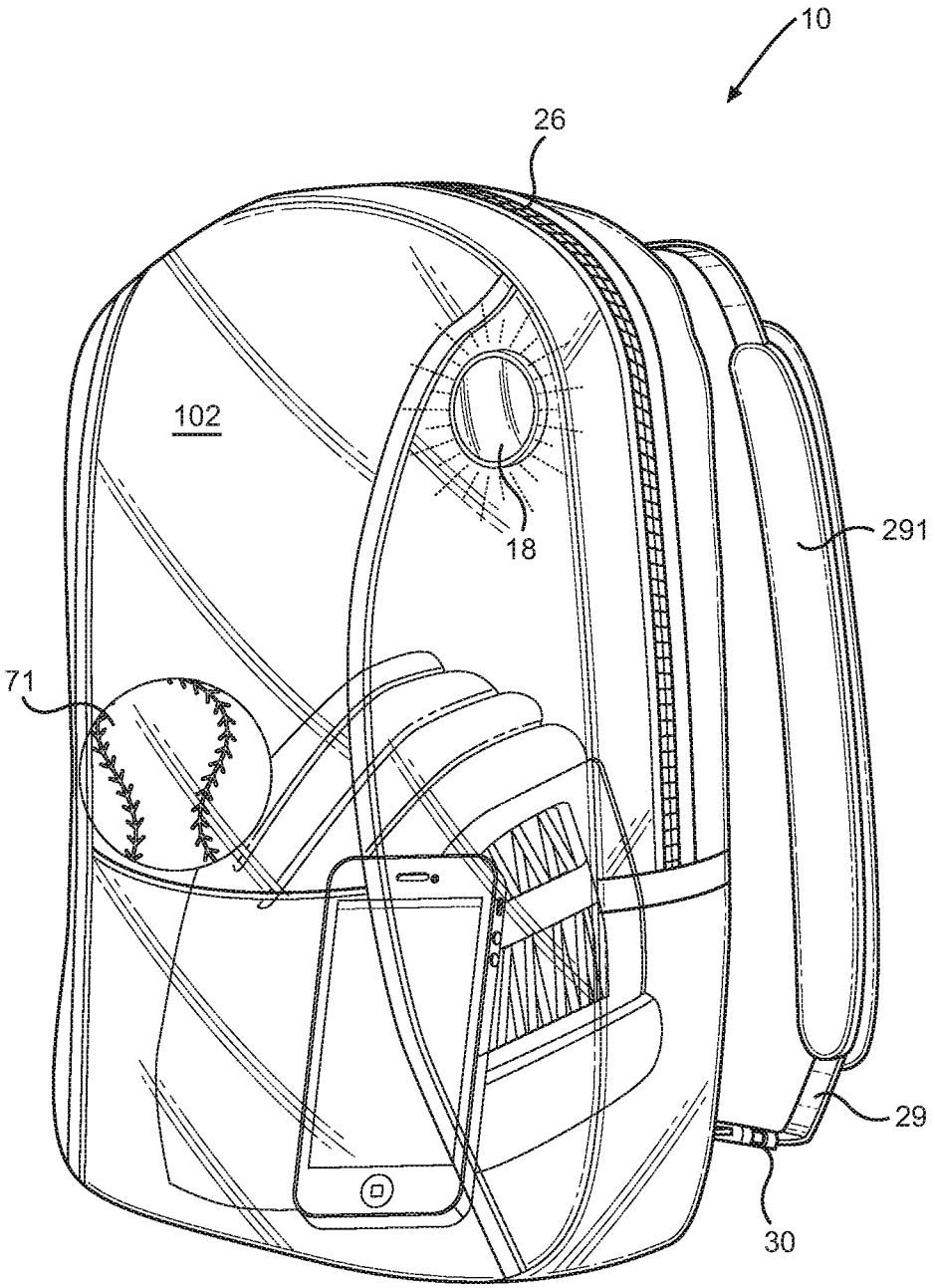
FIG. 3 shows a perspective view of an alternate embodiment of the translucent reconfigurable bag in a folded configuration in use.

Referring to FIG. 3, there is shown a perspective view of an alternate embodiment of the translucent reconfigurable bag in a folded configuration in use. In the illustrated embodiment, the translucent reconfigurable bag 10 is in the folded configuration, wherein the plurality of panels are configured to fold into a backpack. In the illustrated embodiment, the bag fastener 26 comprises a zipper, and extends along a perimeter of the outer side 13 of the translucent reconfigurable bag 10. In this way, the additional length of the bag fastener 26 provides the user with an increased size of the opening into the translucent reconfigurable bag 10, making it easier for the user to reach inside. Additionally, a longer bag fastener 25 provides a secure seal along the entire length of the opening, providing greater protection to the items 71 stored within the interior volume.

In the illustrated embodiment, the light 18 is circularly shaped to provide consistent illumination therearound, such that an equivalent amount of lux is produced around the entirety of the perimeter of the light 18. However, in other embodiments, any suitably stable geometric shape, such as a hexagon or a triangle, can be used. Further, in the shown embodiment the light 18 is disposed on the outer side 102 of the translucent reconfigurable bag 10. In this way, the light 18 can be utilized by the user without requiring the user to first access the interior volume of the translucent reconfigurable bag 10, such that it is easier for the user to find the translucent reconfigurable bag 10 when ambient light is low. Additionally, due to the translucent nature of the panels comprising the translucent reconfigurable bag 10, embodiments having the light 18 disposed on the outer side 102 of the translucent reconfigurable bag 10 in no way diminishes the capability of the user to locate items 71 stored therein.

In the shown embodiment, the translucent reconfigurable bag 10 further comprises at least one strap 29 to aid the user in carrying the translucent reconfigurable bag 10 by allowing the user to transport the translucent reconfigurable bag 10 if they cannot user their hands. In the illustrated embodiment, the strap 29 is removably secured to the translucent reconfigurable bag 10 via a pair of strap fasteners 30. The strap fasteners 30 are disposed at each end of the strap 29, wherein a pair of mated strap fasteners 30 are disposed at two or more positions on the outer side 102 of the translucent reconfigurable bag 10. In the illustrated embodiment, the strap fasteners 30 comprise a pair of clip fasteners to allow the user to quickly attach or detach the strap 29 from the strap fasteners 30. In this way, the user can determine whether they require the use of the strap 29 by choosing to remove or attach it, depending on their preference.

Further, in the illustrated embodiment the strap 28 additionally comprises a padding 291 disposed thereon, such that the padding 291 entirely encases a portion of the strap 29. Thus, in the shown embodiment the padding 291 is disposed on both a front side of the strap 29 and a rear side of the strap 29, such that it wraps around the portion of the strap 29. The padding 291 is configured to be positioned flush against the body of the user when used and is therefore configured to be ergonomic in nature to ensure the user is comfortable wearing the strap 29 and padding 291 for extended periods of time.

In operation, the user will take the planar member, composed of a translucent material and comprising a plurality of panels, and will foldably reconfigure the planar member along the edges of the plurality of panels to form the translucent reconfigurable bag 10 having an interior volume configured to store a plurality of items 71 therein. The outer side of the planar member and the inner side of the planar member each have at least one fastener disposed thereon, such that the inner fastener and outer fastener are configured to removably secure to one another. In this way, the plurality of panels are configured to removably secure to one another when folded to form the interior volume. A light 18 is disposed on the planar member, and in one embodiment is configured to provide illumination to the user in response to an auditory input.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A translucent reconfigurable bag, comprising:

a planar member, having an inner side and an outer side;

the planar member composed of a plurality of panels;

the outer side and the inner side each having at least one fastener configured to removably secure to one another;

wherein the plurality of panels is configured to affix to one another thereby forming an interior volume with an opening in communication with the interior volume;

wherein the plurality of panels includes a central panel having a bottom panel, a top panel, and a pair of side panels extending therefrom;

wherein the bottom panel is tapered such that the interior volume includes a base when the bottom panel is folded;

a light disposed on the planar member configured to actuate automatically;

wherein each panel of the plurality of panels are translucent.

2. The translucent reconfigurable bag of claim 1, wherein the light is automatically activated via an auditory cue.

3. The translucent reconfigurable bag of claim 1, wherein the light is automatically activated through a change in ambient light.

4. The translucent reconfigurable bag of claim 1, wherein the light is disposed on the inner side of the planar member.

5. The translucent reconfigurable bag of claim 1, wherein at least one panel of the plurality of panels are transparent.

6. The translucent reconfigurable bag of claim 1, wherein all the panels of the plurality of panels are transparent.

7. The translucent reconfigurable bag of claim 1, further comprising a bag fastener configured to secure the interior volume of the translucent reconfigurable bag.

8. The translucent reconfigurable bag of claim 7, wherein the bag fastener comprises a zipper.

9. The translucent reconfigurable bag of claim 7, wherein:

the bag fastener comprises a first fastener configured to removably secure to a second fastener;

wherein the first fastener is disposed on the inner side of the planar member and the second fastener is disposed on the outer side of the planar member.

10. The translucent reconfigurable bag of claim 1, further comprising a carrying strap.

11. The translucent reconfigurable bag of claim 1, wherein a portion of the carrying strap is enclosed in an ergonomic padding.

12. The translucent reconfigurable bag of claim 11, wherein the ergonomic padding extends along the entirety of the carrying strap.

13. A translucent reconfigurable bag, comprising:

a planar member, having an inner side and an outer side;

the planar member composed of a plurality of panels;

the outer side and the inner side each having at least one fastener configured to removably secure to one another;

wherein the plurality of panels is configured to affix to one another thereby forming an interior volume with an opening in communication with the interior volume;

wherein the plurality of panels includes a central panel having a bottom panel, a top panel, and a pair of side panels extending therefrom;

wherein the fasteners disposed on the inner side are disposed along a perimeter of the side panels, and the fasteners disposed on the outer side are disposed along a perimeter of the bottom panel;

a light disposed on the planar member configured to actuate automatically;

wherein each panel of the plurality of panels are translucent.

14. The translucent reconfigurable bag of claim 13, wherein the light is automatically activated via an auditory cue.

15. The translucent reconfigurable bag of claim 13, wherein the light is automatically activated through a change in ambient light.

16. The translucent reconfigurable bag of claim 13, wherein the light is disposed on the inner side of the planar member.

17. The translucent reconfigurable bag of claim 13, wherein at least one panel of the plurality of panels are transparent.

18. The translucent reconfigurable bag of claim 13, wherein all the panels of the plurality of panels are transparent.

19. The translucent reconfigurable bag of claim 13, further comprising a carrying strap.

20. The translucent reconfigurable bag of claim 13, wherein a portion of the carrying strap is enclosed in an ergonomic padding.

* * * * *